US008894811B1

(12) United States Patent
Brown

(10) Patent No.: US 8,894,811 B1
(45) Date of Patent: Nov. 25, 2014

(54) AIR DISPERSION OF MINERAL FIBERS IN CEILING TILE MANUFACTURE

(71) Applicant: USG Interiors, LLC, Chicago, IL (US)

(72) Inventor: Martin W. Brown, Gurnee, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 14/054,927

(22) Filed: Oct. 16, 2013

(51) Int. Cl.
*D21H 13/40* (2006.01)
*B28C 5/40* (2006.01)

(52) U.S. Cl.
CPC ..... *D21H 13/40* (2013.01)
USPC ..... 162/3; 162/4; 162/57; 162/145; 162/152; 162/158; 162/189; 366/153.3; 366/154.1; 366/155.1; 406/108; 406/135; 222/226

(58) Field of Classification Search
CPC ... B65G 53/4633; D01G 23/00; D01G 23/02; D21H 13/36; D21H 13/38; D21H 13/40; B28C 5/40; B28C 5/406; B28C 5/00; B44C 5/04; B44C 5/0461; B44C 5/0469
USPC ..... 162/3, 57, 145, 152, 4, 158, 189; 406/64–65, 135, 108; 222/226–227; 241/28, 60, 195, 14, 24.29, 30, 101, 241/121, 4; 366/300, 325.2, 325.3, 153.3, 366/154.1, 155; 264/113, 518
See application file for complete search history.

(56) References Cited

U.S. PATENT DOCUMENTS 2,744,045 A * 5/1956 Collins ..... 264/115
3,025,202 A * 3/1962 Morgan et al. ..... 264/45.3
3,150,215 A * 9/1964 Houghton ..... 264/115
4,097,209 A * 6/1978 Garrick et al. ..... 425/82.1
4,111,493 A 9/1978 Sperber
4,163,036 A * 7/1979 Ransmayr et al. ..... 264/12
4,401,610 A * 8/1983 Ohberg ..... 264/40.4
4,435,353 A * 3/1984 Forry et al. ..... 264/518
4,465,239 A * 8/1984 Woten ..... 241/98
4,869,950 A * 9/1989 Elsen et al. ..... 428/198
4,978,252 A 12/1990 Sperber
5,071,511 A * 12/1991 Pittman ..... 162/145
5,277,762 A 1/1994 Felegi, Jr. et al.
5,647,696 A * 7/1997 Sperber ..... 406/56
5,778,492 A * 7/1998 Thiessen et al. ..... 19/107
5,829,649 A * 11/1998 Horton ..... 222/636
6,616,804 B2 * 9/2003 Foster et al. ..... 162/129
8,133,354 B2 * 3/2012 Baig ..... 162/181.3
8,383,233 B2 * 2/2013 Palm et al. ..... 428/220
2002/0096278 A1 * 7/2002 Foster et al. ..... 162/141
2003/0041987 A1 * 3/2003 Foster et al. ..... 162/145
2009/0173464 A1 * 7/2009 Baig ..... 162/164.1
2011/0247839 A1 * 10/2011 Lalouch et al. ..... 169/45
2012/0164422 A1 * 6/2012 Palm et al. ..... 428/220

* cited by examiner

*Primary Examiner* — Jose Fortuna
(74) *Attorney, Agent, or Firm* — Pearne & Gordon LLP

(57) ABSTRACT

A method of forming a dilute water slurry for water felting a basemat for an acoustical ceiling tile comprising delivering a bale of compressed mineral wool with a density of at least 8 lbs. per cubic foot at an unbaling station, releasing a binding holding the bale in compression, mechanically separating the fibers of a mineral wool bale with mechanical instrumentalities arranged to disperse the fibers to a generally uniform density of less than 2 lbs. per cubic foot prior to passage of the fibers through the tank inlet, and causing the separated mineral fibers to pass into the mixing tank for contact with water suspended binder.

4 Claims, 3 Drawing Sheets

AIR DISPERSION OF MINERAL FIBERS IN CEILING TILE MANUFACTURE

BACKGROUND OF THE INVENTION

The invention relates to manufacture of mineral wool-based acoustical ceiling tile.

PRIOR ART

Mineral wool-based acoustical ceiling tile is conventionally made in a wet felting process using Oliver or Fourdrinier machines, well known in the art. Mineral wool and binder have long been used to form acoustical ceiling tile. Mineral wool is used because it is relatively inexpensive and inert. Mineral wool is typically shipped from a site where it is manufactured to another site where it is used to manufacture acoustical ceiling tiles. Typically, the mineral wool is compressed in bales to reduce its volume to facilitate handling and shipment. A bale of mineral wool may be compressed to a density of at least 8 lbs. per cubic foot.

When compressed and bound into bales, individual mineral fibers become entangled with one another. Long established practice has been to open a bale and break it up with power rotated metal tines or fingers and to deliver the coarsely separated mass of fibers to a mixing tank. The density of the mineral fibers while quite variable due to the coarseness of the bale opening devices can be, by way of example, 5 to 6 lbs. per cubic foot. In the mixing tank, a high speed rotary impeller is used to open and separate the fibers while simultaneously mixing other constituents of the tile basemat to be formed. The conventional practice is to rely on the mixing paddle blades of the mixing tank impeller to detangle the mineral fibers since the fibers were to be received in the tank and the mixing blade was to be employed to disperse the other constituents through all of the water in the tank.

This procedure has been found, however, to have deleterious effects on the mineral wool. The circular mixing action has a tendency to roll the fibers into little balls or nodules that are of greater density than desired. Fiber breakage results in reduced strength in the finished tile and nodulation can reduce potential NRC (noise reduction coefficient) values due to a loss of porosity. The nodules do not interlock or co-mingle with the other constituents.

SUMMARY OF THE INVENTION

The invention is a process for making mineral wool-based acoustical ceiling tile with improved acoustical performance. The inventive process takes the traditional task of fully separating the mineral fibers in a water filled mixing tank and moves the task upstream where dispersion of the mineral fibers is accomplished mechanically in an air environment. It has been discovered that the mineral fibers can be successfully and sufficiently separated, as measured by bulk density of the fibers with mechanical devices operated in air and, optionally, with an air stream so that a ceiling tile with improved properties results. Less fiber bundling occurs when they are dispersed without significant agitation in a water mixing tank allowing the fiber content in a ceiling tile to be reduced without a loss of strength. The reduced fiber content, for a given caliper of a tile, results in greater porosity and, consequently, a higher NRC value. Also adding to the ability to decrease overall fiber content is a reduction or elimination of fiber nodules. Nodules are otherwise created by extended fiber mixing by a high speed water immersed impeller. The nodules are relatively dense and, therefore, do not contribute proportionately to sound reduction. Fiber separation in air upstream of the mixing tank can have the beneficial effect of reducing the content of shot, i.e. the un-fiberized portion, in a given volume of mineral wool.

DESCRIPTION OF THE PREFERRED EMBODIMENT

Figure 1:
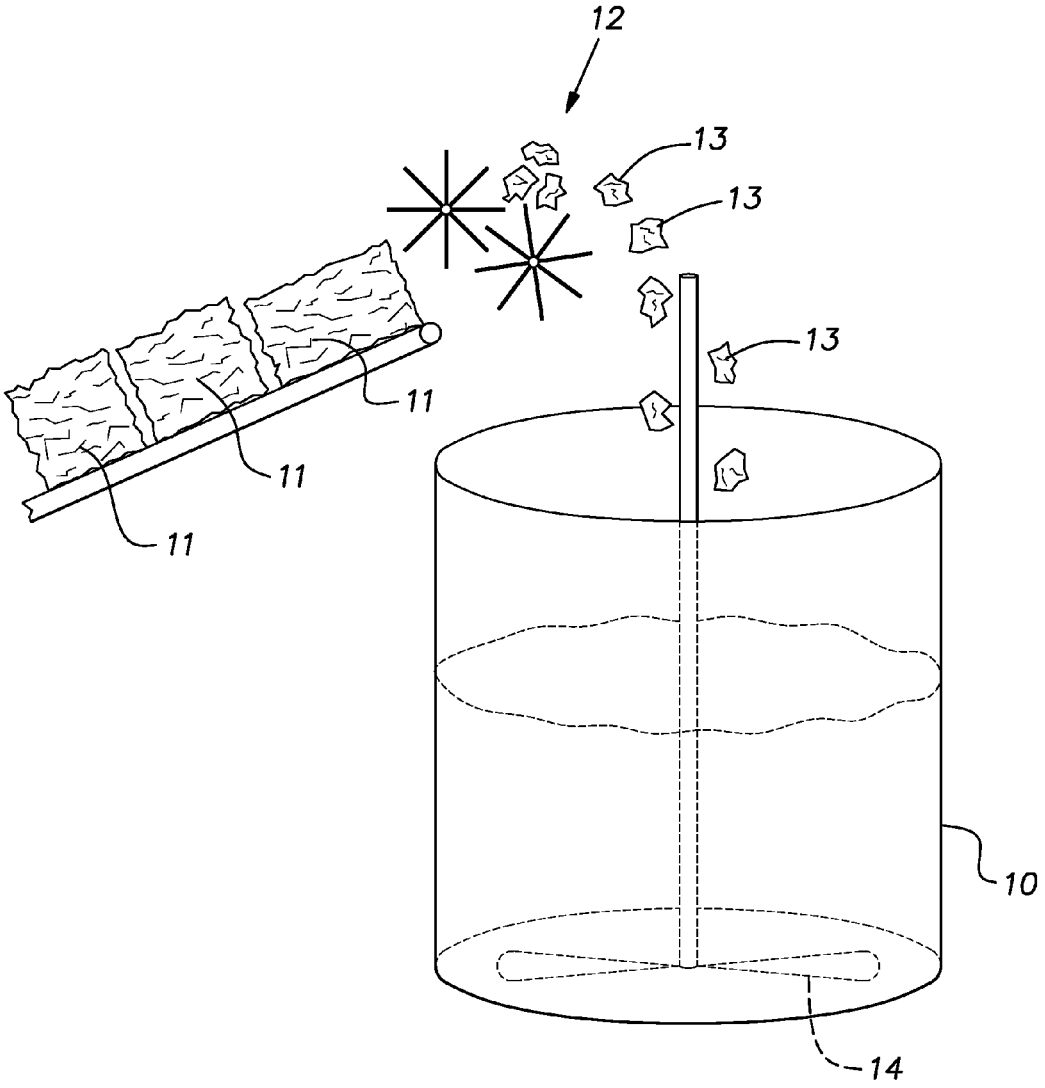
FIG. 1 PRIOR ART
FIG. 1 is a diagrammatic representation of a prior art process for preparing a dilute slurry of mineral fiber and binder for a wet felted acoustical ceiling tile.

Conventionally, in the manufacture of wet felted mineral wool-based acoustical tile, a dilute water slurry of mineral fiber and binder of starch and/or latex, and other minor amounts of solid components is used. The slurry is distributed from a mixing tank onto a travelling wire screen, sometimes simply called a wire. A mixing tank for the slurry is shown in FIG. 1 at 10. It has been the practice to receive large bales 11 of mineral wool held in a compressed state by bands or otherwise from a manufacturer or other source. By way of example, a bale 11 may weigh 1000-1300 lbs. and the mineral wool in the bale can be compressed to a density, for example, of between about 60 and about 65 lbs. per cubic foot. Upon release of the constraining bands, a bale 11 will expand somewhat on its own. The loose bales 11 are conveyed to a bale breaking station 12 where spiked rolls grab and separate clumps 13 of mineral wool from the loose bale 11. The clumps, separated from a bale 11, are directed by the spiked rolls and or chutes (not shown) into the mixing tank 10. The ordinary practice is to separate the clumps 13 of wool into loose fibers with a high speed impeller 14 that simultaneously serves to mix and suspend other constituents in the tank water.

The bulk density of the clumps 13 is approximately 5½ lbs. per cubic foot. In order to disperse the fibers of the mineral wool clumps 13, a typical mixing time can range between about 12 and 15 minutes.

The impeller 14 tends to tumble the mineral fibers and induces the fibers to form tight balls or nodules. The fiber nodulation limits the strength of the tiles in which the fibers are incorporated. The fiber nodules diminish the potential sound absorption ability of the tiles since they decrease homogeneity.

Figure 2:
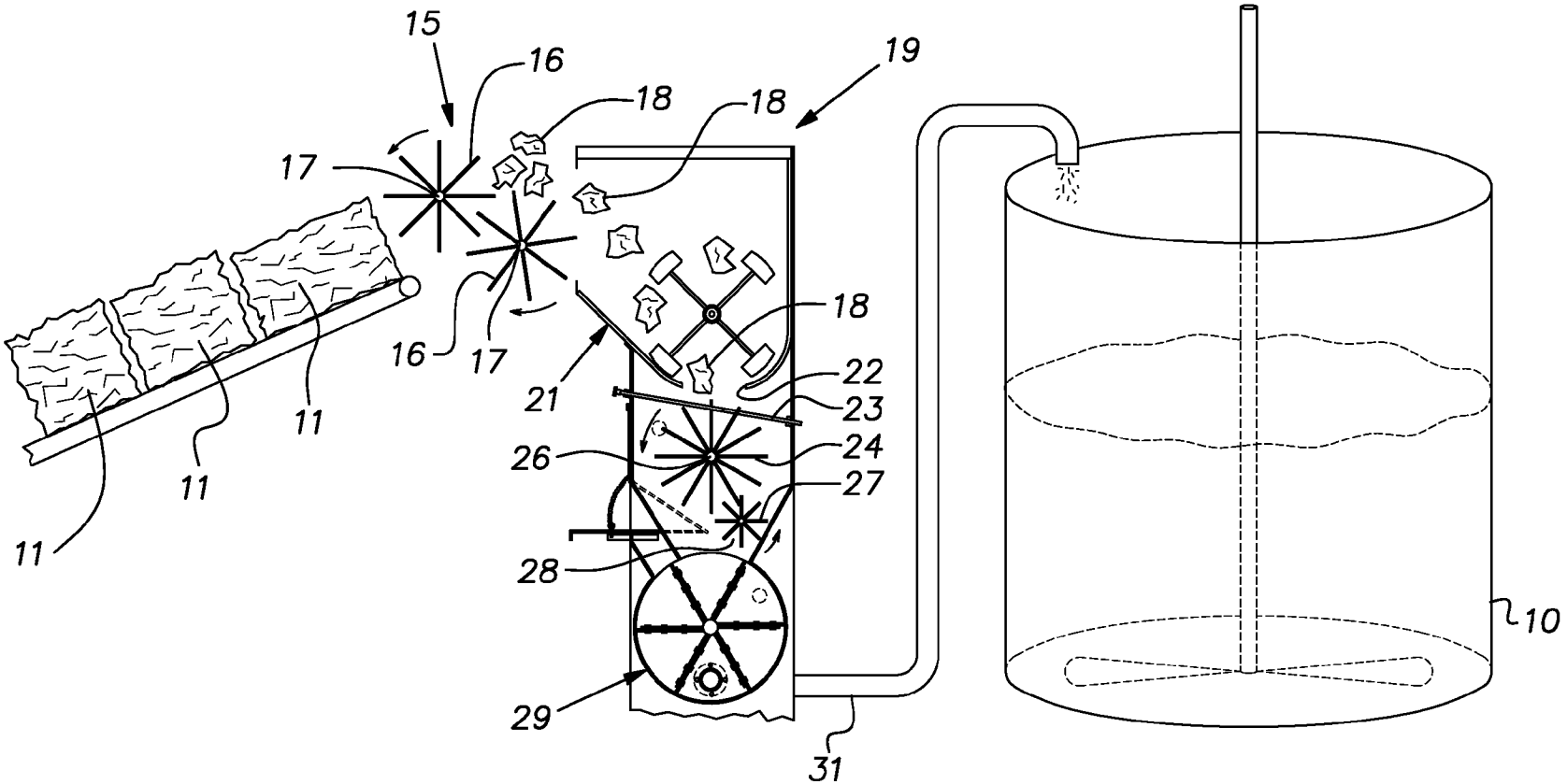
FIG. 2 is a diagrammatic representation of an exemplary process for preparing a dilute slurry of mineral fiber in accordance with the invention.

Referring to FIG. 2, there is depicted an example of the inventive process for effectively dispersing the fibers of mineral wool from one another prior to delivery into a conventional mixing tank 10 so as to eliminate the need for further fiber dispersing action in the mixing tank. Bales 11 of the character described above are released from their binding and carried along a path that ultimately delivers adequately dispersed mineral fibers to the conventional mixing tank 10. The bales 11 are received at a preliminary opening station 15 where meshed spikes or tines 16 on counter-rotating rolls 17 separate the bale 11 into wool clumps or tufts 18 that are subsequently fed into a fiber separator 19. The fiber separator 19, by way of example, but not limitation, may be of the type disclosed in U.S. Pat. Nos. 4,111,493 and 4,978,252. The relatively dense small pieces or clumps 18 of the bales 11 are directed to a hopper 21 of the fiber separator 19 where they are circulated over and caused to fall through a hopper outlet 22.

The clumps 18 are received on a grid 23 (extending perpendicular to the plane of FIG. 2) of parallel bars. The mineral wool clumps 18 are converted into separated fibers by tines or spikes 24 on a rotating shaft 26. The tines 24 pass through the plane of the grid 23 enabling them to operate on the clumps 18. A second set of tines 27 on a shaft 28 meshes between the first set of tines 24 to further separate the fibers. The fibers are propelled downwardly by the tangential motion of the tines 27 and by gravity into a rotary pocket feeder 29. Fibers delivered to a lower part of the feeder 29 are forcibly discharged pneumatically from the fiber separator 19 by compressed air at above atmospheric pressure to a conduit 31.

The conduit 31 discharges into the top opening of the mixing tank 10. The mineral fibers are dispersed to the degree that they have a bulk density of preferably about 2 lbs. per cubic foot, and most preferably between 1.2 and 1.0 lbs. per cubic foot.

Preferably, the tank 10 is filled with water and tile components including a binder of starch and/or latex and optional constituents such as expanded perlite, paper fiber, a filler such as clay, and glass fiber. Preferably, these constituents are premixed before the mechanically air dispersed mineral fibers are delivered into the mixing tank 10. This premixing can minimize the exposure of the dispersed mineral fibers to the breaking and modulating effects of the mixer rotor or impeller 14. Ideally, the mineral fiber slurry is discharged from the tank immediately upon a desired consistency being reached.

The slurry is discharged from the tank 10 onto a moving screen of a wet felting machine such as an Oliver or Fourdrinier machine.

The ability to adequately disperse the mineral wool fibers from the compacted wool bales 11 in an air environment such as by mechanical fingers and with an air stream to transport the fibers pneumatically to a state where they are sufficiently disentangled and dispersed has significant advantage in the manufacture of acoustical ceiling tile. The uniformity and separation of the mineral fibers by dispersion in air can result in a more open mat in a finished ceiling tile than has been practical to obtain by the water dispersion of the prior art.

Variations in the manner of dispersing mineral fibers in air for direct use in a water slurry without significant mixing in the water slurry are contemplated by the invention. Various arrangements using rotating, reciprocating and/or oscillating mechanical fingers or tines and/or air jets and/or air stream can be implemented in a path from a bale receiving station to a slurry mixing tank. These devices and expedients should reduce the density of the fibers to at least 2 lbs. per cubic foot before they are introduced to the mixing tank. An air stream can be provided by an air source operating above atmospheric pressure or a suction device operating below atmospheric pressure. While the relatively simple fiber separation system disclosed above has proven to obtain improvements in the performance of acoustical tile, it is expected that more elaborate air dispersion processes can be used with even greater success and higher throughput.

Figure 3:
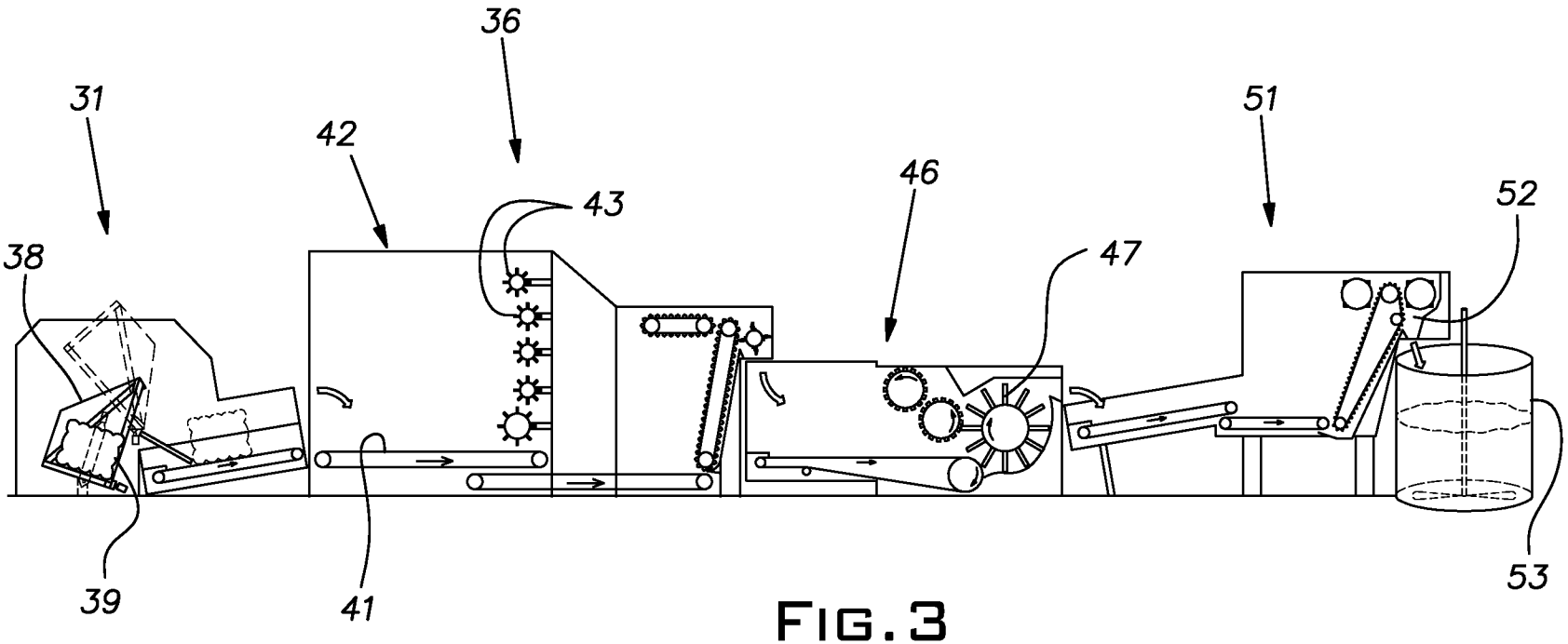
FIG. 3 illustrates a multi-station system for refined control of mineral fiber separation.

FIG. 3 illustrates a more extensive fiber separating system which can afford more control over mineral fiber separation than that afforded by the system of FIG. 2. The system 36 comprises a number of stations that employ bale and fiber handling units that are commercially available from one or more manufacturers. A first station 37 provides a tipper unit 38 for an unbound bale 39 of compacted mineral fiber. The tipper unit 38 deposits the unbound bale 39 of mineral fiber onto a conveyor 41 of a bale opener 42 comprising the second unit of the system 36. The bale opener 42 includes spiked rolls 43 that break the bale 39 down into uncompacted fibers. From the bale opener 42 the fibers are delivered to an auxiliary fiber separator unit 46 representing the third station of the system 36. The auxiliary fiber separating unit 46 can reduce the shot content of the mineral fiber stream.

Fibers are delivered from a rotating paddle wheel 47 of the auxiliary unit 46 to a final or fourth station 51. Fibers received in the fourth station are conveyed and elevated to a weighing hopper 52 at which well separated mineral fibers are collected until a predetermined weight or mass of such fibers is gathered. When the fiber weight reaches the predetermined level, the hopper 52 is opened to release the fibers into a mixing tank 53 which serves the same function as the tank 10 described in connection with FIGS. 1 and 2 above.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of forming a dilute water slurry for water felting a basemat for an acoustical ceiling tile comprising delivering a bale of compressed mineral wool with a density of at least 8 lbs. per cubic foot at an unbaling station, releasing a binding holding the bale in compression, mechanically separating the fibers of the mineral wool bale with mechanical instrumentalities and optionally an air stream at stations in a path between the unbaling station and a mixing tank, the instrumentalities or air stream and, optionally, a conveyor or conveyors being arranged to conduct the separated fibers along the path to an inlet of the tank, arranging the fiber separating instrumentalities to separate the fibers to a generally uniform density of less than 2 lbs. per cubic foot prior to passage of the fibers through the tank inlet, and causing the separated mineral fibers to pass into the mixing tank for contact with water suspended binder, mechanically mixing a binder and optionally other constituent materials used in the production of a wet felted basemat in the tank by a rotating blade prior to introduction of the separated mineral fibers into the mixing tank whereby modulation and breakage of the separated mineral fibers is reduced.

2. A method as set forth in claim 1, wherein the airstream is created by an air source operating above atmospheric pressure.

3. A method as set forth in claim 1, wherein an airstream is created by a suction device operating to develop an air pressure in the path below atmospheric pressure.

4. A method as set forth in claim 1, wherein the contents of the mixing tank are discharged when the separated mineral fibers are received in the tank whereby nodulation and breakage of the separated mineral fibers by agitation thereof by the mixing blade is avoided.

* * * * *